US009033458B2

(12) United States Patent
Aruga

(10) Patent No.: US 9,033,458 B2
(45) Date of Patent: May 19, 2015

(54) LIQUID EJECTING HEAD AND LIQUID EJECTING APPARATUS

(71) Applicant: SEIKO EPSON CORPORATION, Tokyo (JP)

(72) Inventor: Yoshiharu Aruga, Azumino (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 14/225,229

(22) Filed: Mar. 25, 2014

(65) Prior Publication Data

US 2014/0292859 A1 Oct. 2, 2014

(30) Foreign Application Priority Data

Mar. 26, 2013 (JP) ..... 2013-063562

(51) Int. Cl.

| | |
|---|---|
| ***B41J 2/015*** | (2006.01) |
| ***B41J 2/045*** | (2006.01) |
| ***B41J 2/14*** | (2006.01) |
| ***B41J 2/15*** | (2006.01) |
| ***B41J 29/377*** | (2006.01) |

(52) U.S. Cl.

CPC ..... *B41J 2/04501* (2013.01); *B41J 2/14* (2013.01); *B41J 2/14201* (2013.01); *B41J 2/15* (2013.01); *B41J 29/377* (2013.01); *B41J 2002/14241* (2013.01); *B41J 2002/14362* (2013.01); *B41J 2202/19* (2013.01)

(58) Field of Classification Search

CPC ..... B41J 2/04501; B41J 2/15; B41J 29/377; B41J 2/14201; B41J 2/14; B41J 2002/14362; B41J 2002/14241; B41J 2202/19

USPC ..... 347/9, 37, 20, 49, 50

See application file for complete search history.

(56) References Cited

U.S. PATENT DOCUMENTS

| | | | | |
|---|---|---|---|---|
| 8,056,999 | B2 * | 11/2011 | Gardner et al. | 347/9 |
| 2007/0070103 | A1 * | 3/2007 | Akune et al. | 347/10 |

FOREIGN PATENT DOCUMENTS

| | | |
|---|---|---|
| JP | 2006-150593 A | 6/2006 |

* cited by examiner

*Primary Examiner* — Julian Huffman
(74) *Attorney, Agent, or Firm* — Maschoff Brennan

(57) ABSTRACT

A liquid ejecting head which includes a head unit in which a plurality of unit heads are arranged, a controller that transmits a control signal to the head unit, and a frame on which a plurality of the head units and the controllers are fixed, wherein the frame includes a head unit fixing section in which the head units are arranged side by side with the nozzle surface being exposed and a controller fixing section which is stacked on the head unit fixing section on the side opposite to the nozzle surface and in which the controllers are arranged side by side in an arrangement direction of the head units, the controller fixing section is composed of at least two layers, where the controllers which correspond to the adjacent head units are arranged alternately in the at least two layers in the controller fixing section.

11 Claims, 10 Drawing Sheets

LIQUID EJECTING HEAD AND LIQUID EJECTING APPARATUS

RELATED APPLICATIONS

The present invention claims priority to Japanese Patent Application No. 2013-063562, filed Mar. 26, 2013, which is incorporated herein by reference in its entirety.

BACKGROUND

1. Technical Field

The present invention relates to a liquid ejecting head which includes a plurality of unit heads that eject a liquid through nozzles and a liquid ejecting apparatus having the same.

2. Related Art

Liquid ejecting apparatuses are devices which include a liquid ejecting head that allows a liquid to be ejected as liquid droplets through nozzles and are configured to eject a variety of liquids from the liquid ejecting head. Typical examples of liquid ejecting apparatuses include image recording apparatuses, including ink jet recording apparatuses (or printers), which include an ink jet recording head (hereinafter, referred to as a recording head) which perform recording by ejecting ink in the form of liquid as ink droplets through nozzles of the recording head. The liquid ejecting apparatuses are also used to eject a variety of liquids such as a color material used for color filters of liquid crystal displays, an organic material used for organic electro luminescence (EL) displays, and an electrode material used for making electrodes. The recording head for image recording apparatuses ejects ink in the form of liquid. Further, a color material ejection head for display manufacturing apparatuses ejects solution of red (R), green (G) and blue (B) color materials. Moreover, an electrode material ejection head for electrode manufacturing apparatuses ejects an electrode material in the form of liquid, and a bio-organic material ejection head for chip manufacturing apparatuses ejects a bio-organic solution.

JP-A-2006-150593 discloses a printer which includes a recording head that includes a plurality of head units (line heads) in which a plurality of unit heads that eject ink are arranged in line, and the head units are arranged side by side on a fixation member such as a frame. The unit heads are configured to introduce ink from ink supply sources such as ink cartridges into pressure chambers (pressure generating chambers), generate a pressure change of the ink in the pressure chambers by actuating a pressure generating section such as a piezoelectric element and a heat generating element, and cause ink in the pressure chambers to be ejected as ink droplets through openings on a nozzle surface by using the pressure change. The recording head further includes a plurality of controllers which correspond to the head units and transmit control signals to the pressure generating section.

In recent years, the head units have become increasingly compact while the controllers have become larger relative to the head units. When the head units are arranged side by side on the frame and the controllers which correspond to the head units are arranged side by side along the arranged head units on the frame, the entire length of the controllers in the arrangement direction is larger than the entire length of the head units in the arrangement direction. As a consequence, it has been difficult to reduce the size of the recording heads. A configuration has been possible in which a recording head is mounted on a housing of the printer or the like without the associated controllers. However, this configuration is not practical since this needs a complicated layout of cables that electrically connect the respective head units to their associated controllers.

SUMMARY

An advantage of some aspects of the invention is a compact liquid ejecting head and a liquid ejecting apparatus having the same.

According to an aspect of the invention, a liquid ejecting head includes a head unit in which a plurality of unit heads are arranged, the unit heads being configured to eject a liquid through a nozzle formed on a nozzle surface by using a pressure change in a pressure chamber which is generated by driving a pressure generating section, a controller that transmits a control signal for controlling driving of the pressure generating section to the head unit, and a frame on which a plurality of the head units and the controllers which correspond to the head units are fixed, wherein the frame includes a head unit fixing section in which the head units are arranged side by side with the nozzle surface being exposed and a controller fixing section which is stacked on the head unit fixing section on the side opposite to the nozzle surface and in which the controllers are arranged side by side in an arrangement direction of the head units, the controller fixing section is composed of at least two layers, and the controllers which correspond to the adjacent head units in the arrangement direction in the head unit fixing section are arranged alternately in at least two layers in the controller fixing section.

With this configuration, even if the width of the controller is larger than the width of the head unit, the entire width of the arranged controllers can be substantially same as the entire width of the arranged head units which are arranged as compact as possible. As a result, the liquid ejecting head can be reduced in size.

According to another aspect of the invention, liquid ejecting apparatus includes the liquid ejecting head according to the above aspect.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the attached drawings. In the following embodiment, various limitations are described as the specific examples of the preferred embodiments of the invention. However, the invention is not limited to those embodiments unless otherwise specifically described herein. A liquid ejecting apparatus according to the invention will be described by way of example of an ink jet printer (hereinafter, referred to as a printer) in which an ink jet recording head (hereinafter, referred to as a recording head) which is an example of liquid ejecting head is mounted.

Figure 1A:
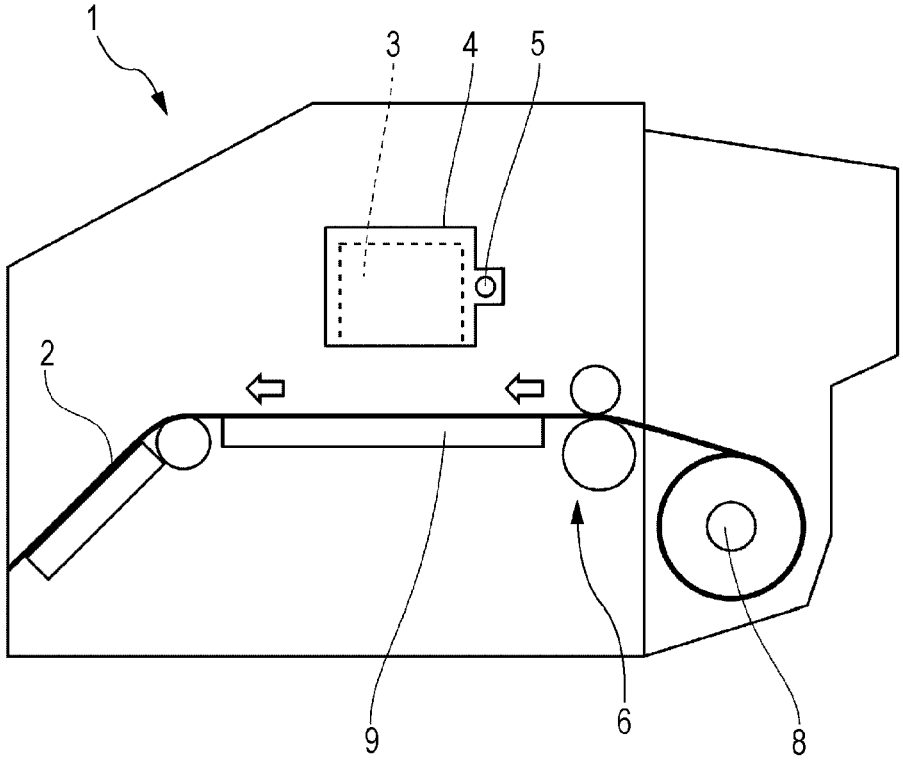
FIG. 1A is a schematic sectional view of a configuration of a printer.
Figure 1B:
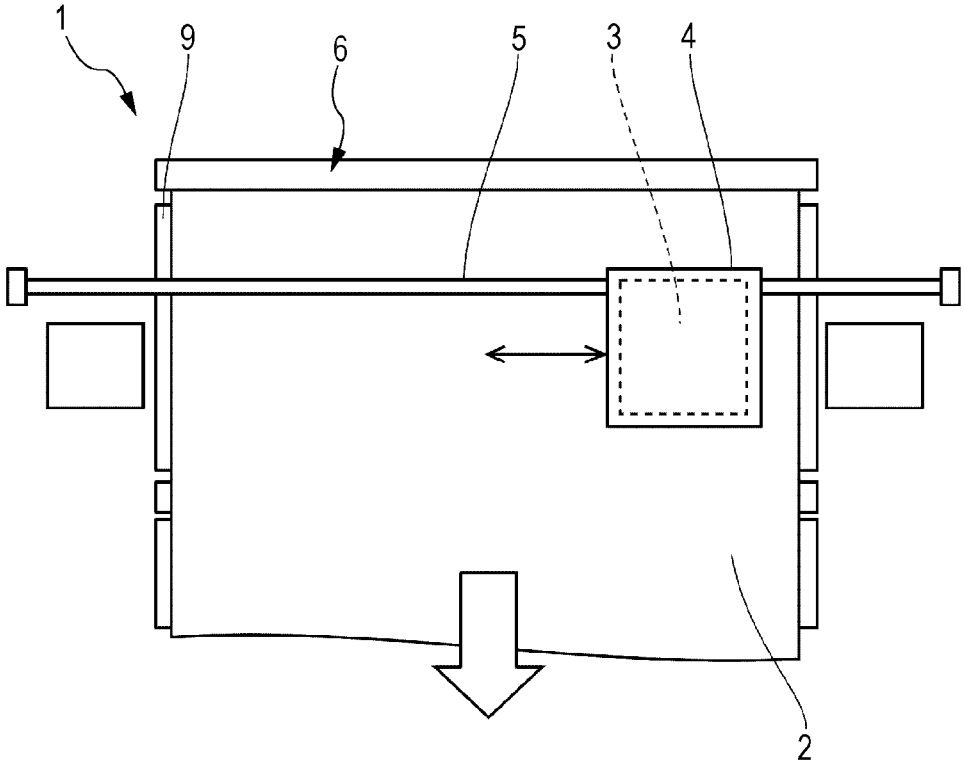
FIG. 1B is a schematic plan view of a configuration of the printer.

A configuration of a printer 1 will be described with reference to FIGS. 1A and 1B. The printer 1 is a device that performs dyeing or recording of images by ejecting ink in the form of liquid onto the surface of a recording medium 2 (a type of ejection target) such as a piece of cloth or paper. The printer 1 includes a recording head 3, a carriage 4 on which the recording head 3 is mounted, a guide rod 5 that supports the carriage 4, a transportation mechanism 6 that transports the recording medium 2 in a sub-scan direction (the arrow direction in FIG. 1A) and the like. The recording medium 2 of this embodiment is wound around and held on a core 8. In an alternative configuration, a plurality of recording media 2 may be stored in a tray disposed in the lower part of the printer 1 and a transportation mechanism may transport the media 2 sheet by sheet.

The recording medium 2 is transported on a platen 9 which is disposed a predetermined distance apart from the underside (nozzle surface 58, see FIG. 11) of the recording head 3 by driving the transportation mechanism 6. Further, ink is stored in a liquid supply source (not shown in the figure) such as an ink cartridge which is mounted on the main body of the printer 1 and is supplied to the recording head 3 via an ink supply tube. In an alternative configuration, the liquid supply source may be mounted on the carriage 4.

The guide rod 5 is disposed in the printer 1 and extends in a main scan direction which is perpendicular to the sub-scan direction. The carriage 4 reciprocates in the main scan direction (the width direction of the recording medium 2) by a pulse motor (not shown in the figure) such as a DC motor while being guided by the guide rod 5. A home position which serves as a base point for scanning by the carriage 4 is provided in an end area within a movement range of the carriage 4 and outside of a recording area (an area outside of the platen 9 in the main scan direction). The printer 1 is configured to perform so-called bidirectional recording in which text and images are recorded on the recording medium 2 while the carriage 4 moves in two directions, that is, from the home position to the opposite end and from the opposite end to the home position.

Figure 2:
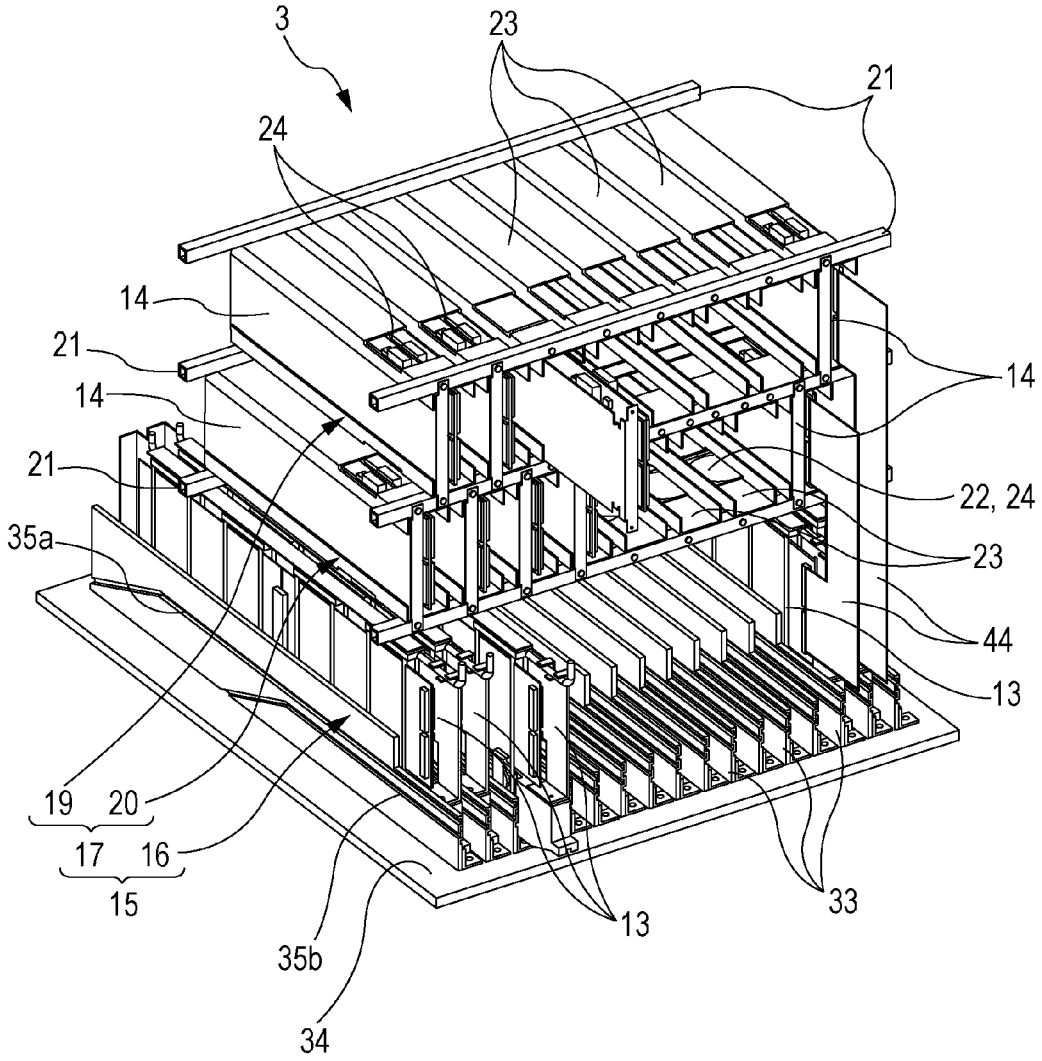
FIG. 2 is a perspective view in which part of a recording head is not shown.
Figure 3:
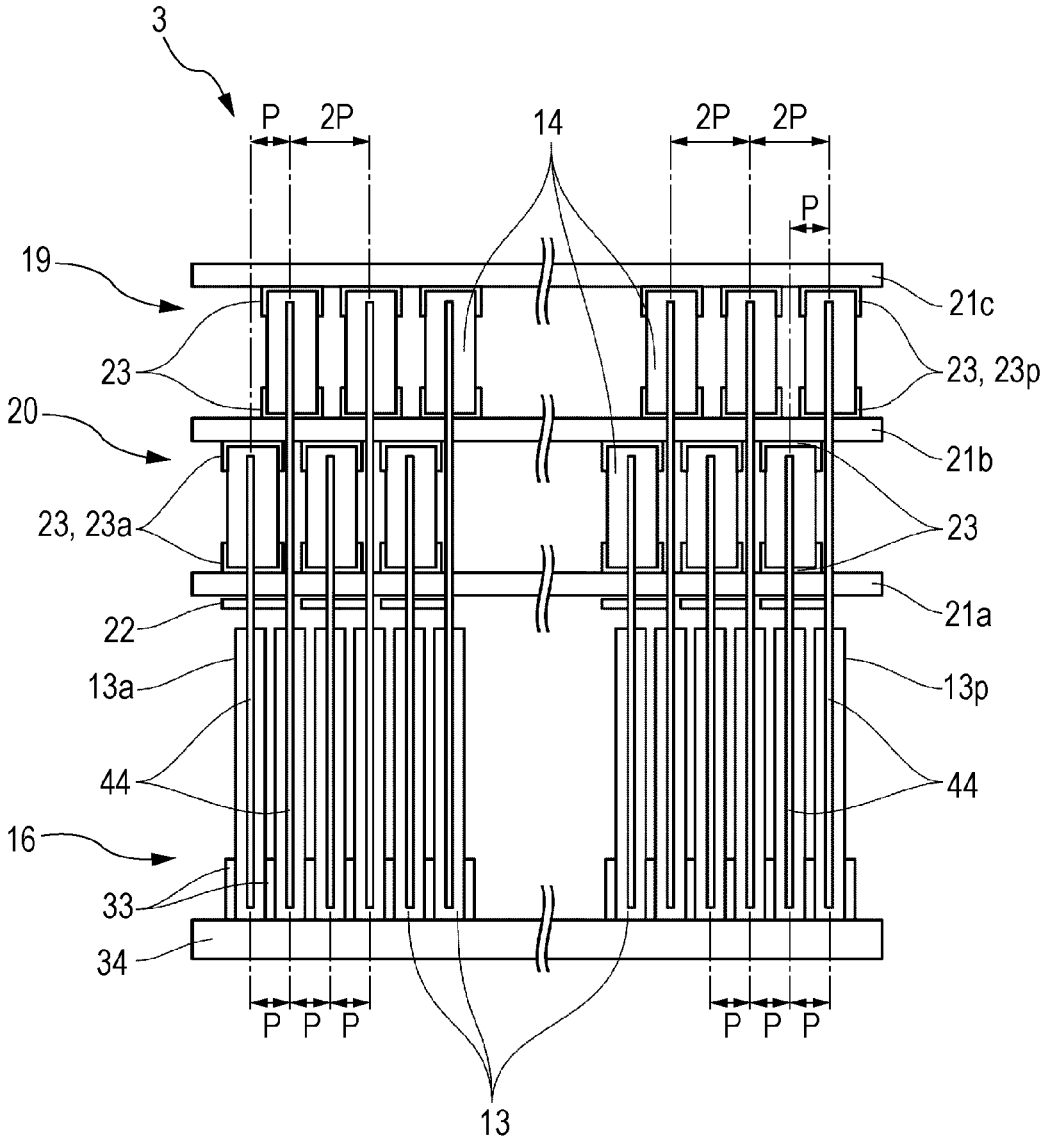
FIG. 3 is a schematic front view of the recording head.

Next, the recording head 3 will be described with reference to the drawings. FIG. 2 is a perspective view of the recording head 3 according to this embodiment and FIG. 3 is a schematic front view of the recording head. In FIG. 2, a part of head units 13, and controllers 14 are shown, while the flexible cables 44 are not shown. Further, part of the head units 13 and the controllers 14 are shown as being pulled forward from a fix position of a frame 15.

As shown in FIG. 2, the recording head 3 of this embodiment includes the head units 13 formed in a plate shape, the controllers 14 formed in a plate shape, and the frame 15 on which a plurality of the head units 13 and the controllers 14 are fixed. The frame 15 includes a head unit fixing section 16 and a controller fixing section 17 which is stacked on the head unit fixing section 16 (on the side opposite to the nozzle surface 58, which will be described below). The head units 13 are arranged side by side in standing position and are fixed on the head unit fixing section 16, and the controllers 14 are arranged side by side in standing position in the arrangement direction of the head units 13 and are fixed on the controller fixing section 17. In this embodiment, sixteen head units 13 are arranged side by side in the head unit fixing section 16, and accordingly, sixteen controllers 14 corresponding to the head units 13 can be arranged side by side in the controller fixing section 17.

Figure 4:
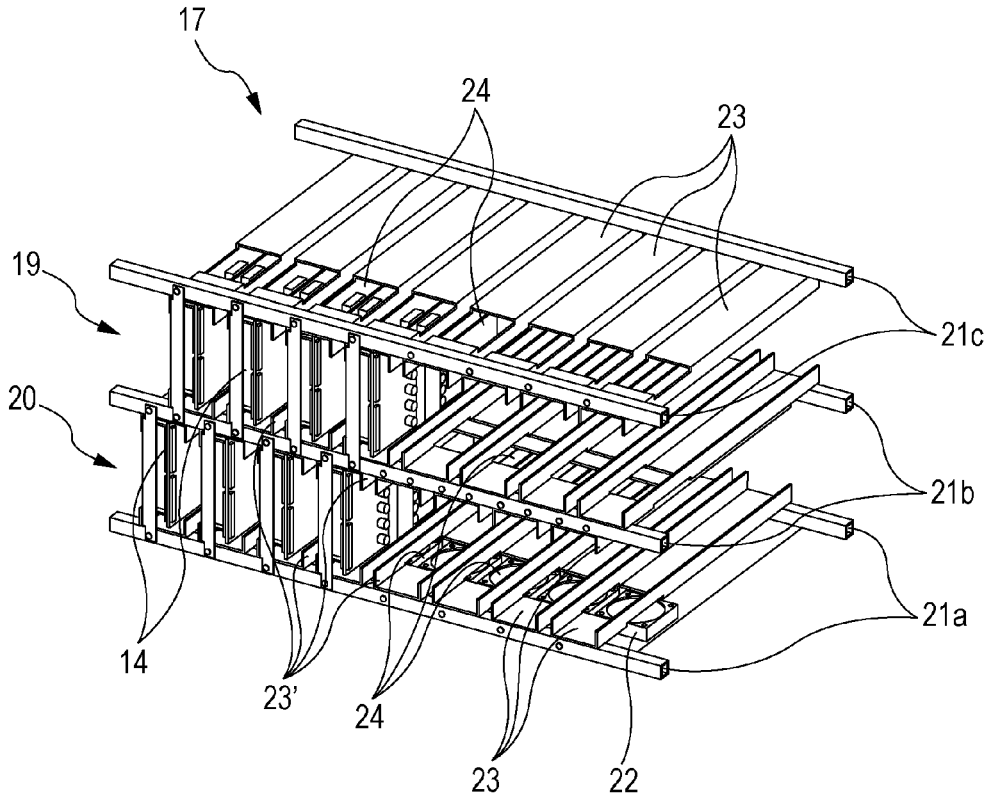
FIG. 4 is a perspective view of a controller fixing section.

As shown in FIGS. 3 and 4, the controller fixing section 17 which forms the upper part of the frame 15 includes an upper layer 19 and a lower layer 20 which are stacked (overlapped) in the vertical direction. The controllers 14 are arranged side by side in each of the upper and lower layers 19, 20. The upper and lower layers 19, 20 correspond to a layer section of the invention. In this embodiment, eight controllers 14 are arranged side by side in the upper layer 19 and eight controllers 14 are arranged side by side in the lower layer 20.

A bottom face (which is located on the side of the head unit) and a top face (which is located on the side opposite to the head unit) of each of the upper and lower layers 19, 20 are formed by positioning members 23 for positioning the controllers 14 between two beams 21 which extend parallel to each other in the arrangement direction of the controllers 14 across the width of the controller fixing section 17. Specifically, the controller fixing section 17 includes two lower beams 21*a* which are disposed at lower positions, two intermediate beams 21*b* which are disposed above the lower beams 21*a* and two upper beams 21*c* which are disposed above the intermediate beams 21*b*. The distance between the lower beams 21*a* and the intermediate beams 21*b*, and the distance between the intermediate beams 21*b* and the upper beams 21*c* are same as the height of the controller 14. Further, the distance between each of the two beams 21*a*, 21*b*, 21*c* are substantially same as the length of the controller 14 (the length in the depth direction which is perpendicular to the arrangement direction of the controllers 14).

The positioning members 23 are plate members having the width (the length in the arrangement direction of the controllers 14) which is the same as that of the controller (the thickness in the arrangement direction of the controller 14) and the length (the length in the depth direction which is perpendicular to the arrangement direction of the controllers 14) which is the same as that of the controller 14. As shown in FIG. 4, the positioning members 23 have walls 23' which extend from the bottom face of the positioning members 23 at both ends in the width direction toward the side of the controllers 14. The bottom face of the lower layer 20 is formed by a plurality of positioning members 23 which are arranged on the upside of the two lower beams 21*a* at equal pitch in the width direction with the walls 23' extending upward. The top face of the lower layer 20 is formed by a plurality of positioning members 23 which arranged on the underside of two intermediate beams 21*b* at equal pitch in the width direction with the walls 23' extending downward, and the bottom face of the upper layer 19 is formed by a plurality of positioning members 23 which are arranged on the upside of the two intermediate beams 21*b* at equal pitch in the width direction with the walls 23' extending upward. The top face of the upper layer 19 is formed by a plurality of positioning members 23 which are arranged on the underside of two lower beams 21*c* at equal pitch in the width direction with the walls 23' extending downward.

Pairs of the positioning members 23 which are disposed at upper and lower positions in the overlapped direction of the upper and lower layers 19, 20 (the stacking direction of the upper and lower layers 19, 20, the direction that the upper and lower layers 19, 20 are stacked) hold the corresponding controllers 14 from both sides so as to position the controllers 14. That is, the controllers 14 are positioned in the width direction by the walls 23' of the positioning members 23, and are positioned in the height direction by the bottom faces of the positioning members 23 which are located on the upper and lower sides of the controllers 14. As shown in FIG. 3, the arrangement pitch of the positioning members 23 arranged side by side in the upper layer 19 and the arrangement pitch of the positioning members 23 arranged side by side in the lower layer 20 are two times of the arrangement pitch P (2P) of the head units 13. The positioning members 23 arranged side by side in the upper layer 19 and the positioning members 23 arranged side by side in the lower layer 20 are offset by the arrangement pitch P (P) of the head units 13.

In this embodiment, the overall width spanned by the arranged controllers 14 in the arrangement direction is substantially same as the overall width spanned by the arranged head units 13. That is, as shown in FIG. 3, the positioning member 23*a* which is located at one end of the lower layer 20 in the arrangement direction is right above the head unit 13*a* which is located at one end of the head unit fixing section 16, while the positioning member 23*p* which is located on the other end of the upper layer 19 is right above the head unit 13*p* which is located at the other end of the head unit fixing section 16. Accordingly, in the state in which the head units 13 are fixed on the head unit fixing section 16 and the controllers 14 are fixed on the controller fixing section 17, the controllers 14 which correspond to the respective head units 13 are arranged alternately in the upper layer 19 and the lower layer 20 at positions right above the respective head units 13. In other words, the controllers 14 which correspond to adjacent head units 13 in the arrangement direction in the head unit fixing section 16 are arranged alternately in the upper layer 19 and the lower layer 20.

In addition, a plurality of fans 22 (which correspond to a blower in the invention) are disposed under the controller fixing section 17. The fans 22 are disposed at positions which correspond to the heatsinks 29 of the controllers 14, which will be described later. As shown in FIG. 4, through holes 24 are provided on the positioning members 23 that form the bottom face of the controller fixing section 17 so as to penetrate the positioning members 23 in the thickness direction at positions (on the bottom face) which correspond to the heatsinks 29. Accordingly, the fans 22 can blow air toward the controllers 14 through the through holes 24 to cool the heatsinks 29. In this embodiment, the through holes 24 are disposed on the positioning members 23 located on the upper and lower sides of the layers 19, 20. The through holes 24 of the positioning members 23 are provided at positions (on the bottom face) which face the fans 22 so that air flows from the lower side to the upper side of the controller fixing section 17 through the through holes 24. Accordingly, the heatsinks 29 of the layers 19, 20 can be cooled.

Figure 5:
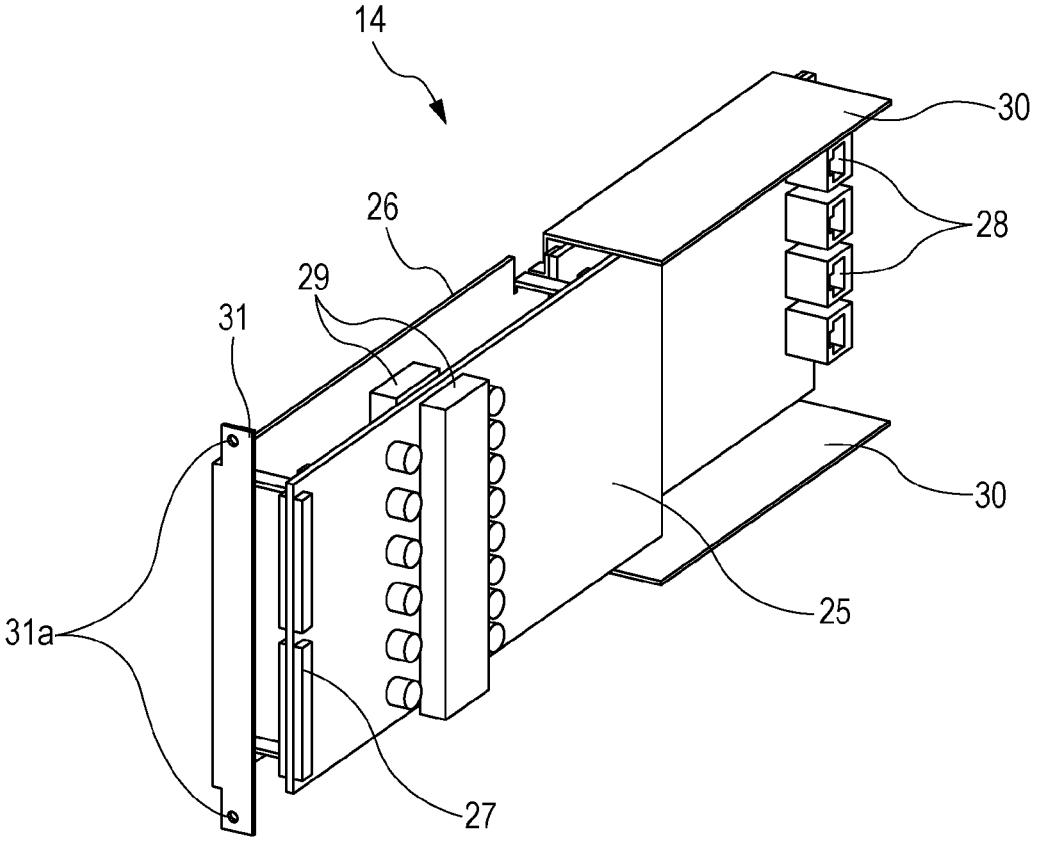
FIG. 5 is a perspective view of the controller.

As shown in FIG. 5, each controller 14 fixed on the controller fixing section 17 includes a control substrate 25 that outputs control signals for controlling driving of a piezoelectric element 65, as is described more fully below, and transmits the control signals to the head unit 13 and a substrate fixing member 26 on which the control substrate 25 is fixed. The controller 14 of this embodiment has a width (the thickness in the arrangement direction) which is larger than a width of the head unit 13 (for example, the width of the head unit 13 is 30 mm, and the width of the controller 14 is 50 mm). On the control substrate 25, electronic components such as ICs and transistors, which are not shown in the figure, are mounted. A connector 27 is disposed on one end (front end) of the control substrate 25. The flexible cable 44 (which corresponds to a wire member of the invention) is electrically connected to a transmission substrate 38 (which will be described later) of the corresponding head unit 13, and is electrically connected to the connector 27 at the other end.

If the controllers 14 are arranged in a single layer, the arrangement pitch of the controllers 14 becomes larger than the arrangement pitch of the head units 13, since the width of the controller 14 of this embodiment is larger than the width of the head unit 13. This results in a configuration where the flexible cable 44 which is connected to the controller 14 located at the end in the arrangement direction is in inclined position. However, the controllers 14 of this embodiment are arranged alternately in the upper layer 19 and the lower layer 20, and the controllers 14 are located right above the corresponding head units 13. Accordingly, the flexible cables 44 that connect the controllers 14 and the head units 13 can be substantially perpendicular to the nozzle surface 58. As a result, the flexible cables 44 are arranged without crossing each other (in this embodiment, parallel to each other), thereby facilitating connection of the wire members. Accordingly, it is possible to shorten the work time required for replacing the head units 13 and the controllers 14 in a maintenance operation or the like.

Further, LAN connectors 28 are disposed on the other end (rear end) of the control substrate 25. LAN cables are electrically connected to a main body control substrate (not shown in the figure) which is disposed on the housing of the printer 1 at one end, and are electrically connected to the LAN connectors 28 at the other end. The control substrate 25 generates control signals in response to signals from the main body control substrate, and transmits the control signals to the piezoelectric elements. The control substrate 25 on one controller 14 controls a recording operation of the corresponding one head unit 13.

As will be described later, a plurality of unit heads 36 are mounted on the head unit 13. Accordingly, an information processing amount of the control substrate 25 that controls driving of the head unit 13 increases. Accordingly, heat generation of the control substrate 25 tends to increase. In this embodiment, the control substrate 25 is provided with the heatsinks 29 (which corresponds to a heat dissipation section of the invention) that dissipate heat into the air. Specifically, the heatsinks 29 are disposed on both sides of the control substrate 25 at positions backward of the connector 27 of the control substrate 25. Since the fans 22 described above blow air toward the heatsinks 29, it is possible to prevent problems caused by heat generation of the control substrate 25.

The substrate fixing member 26 is a plate member which is made of a metal such as SUS and supports the control substrate 25 from one side. The substrate fixing member 26 can shield noise such as electromagnetic wave to the control substrate 25. Positioning walls 30 are disposed to extend from the upper and lower ends on the rear end of the substrate fixing member 26 to the side of the control stator 25. The positioning walls 30 extend in the width direction (arrangement direction) of the controllers 14 so that the width of the controller 14 is defined by the positioning wall 30. The width of the positioning walls 30 are the same as the interval between the walls 23' of the positioning member 23. When the controllers 14 are fixed on the controller fixing section 17, the positioning walls 30 fit the positioning members 23, thereby defining the position of the controllers 14 in the width direction. Further, a fixation section 31 which is integrally formed with the substrate fixing member 26 is disposed on the front end of the controller 14. The fixation section 31 extends upward and downward in the height direction from the front end of the controllers 14 such that the height of the fixation section 31 is larger than the height of each of the layers 19, 20 (the distance between the beams 21 in the height direction). Accordingly, when the control substrates 25 are assembled to each of the layers 19, 20 of the controller fixing section 17 by sliding the control substrates 25 into the layers 19, 20 from the rear end of the control substrates 25, the upper and lower ends of the fixation section 31 abut against the upper and lower beams 21, respectively, thereby preventing the control substrates 25 from being slid further in the back direction. Further, screw holes 31*a* are provided on the upper and lower ends of the fixation section 31 so that the fixation section 31 is fixed on the beams 21 by using screws or the like with the fixation section 31 abutting against the beams 21. Accordingly, the controllers 14 are fixed on the controller fixing section 17.

Figure 6:
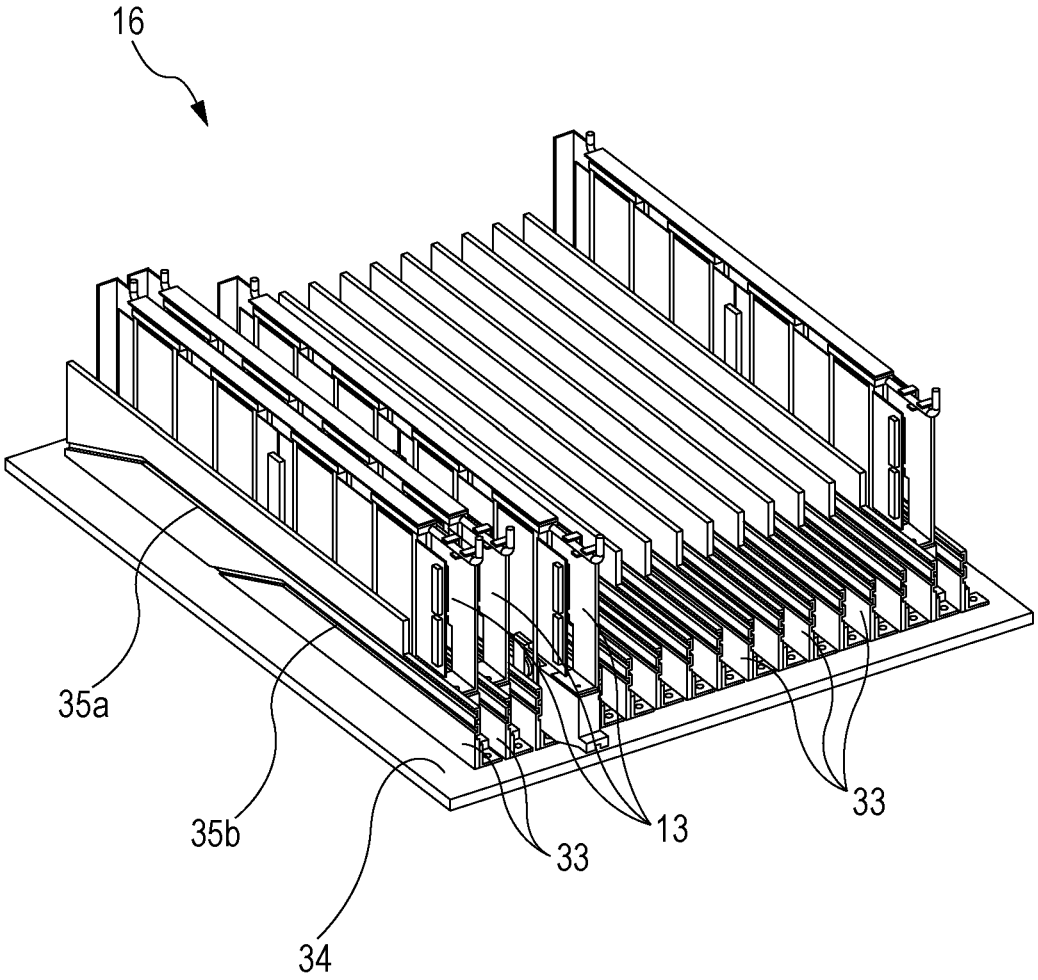
FIG. 6 is a perspective view of a head unit fixing section.

Next, the head unit fixing section 16 will be described. The head unit fixing section 16 forms the lower part of the frame 15 which lies under the controller fixing section 17. As shown in FIG. 6, a plurality of guide walls 33 are arranged side by side in the arrangement direction of the head units 13 on the head unit fixing section 16. The guide walls 33 of this embodiment vertically stand from a bottom plate 34 of the head unit fixing section 16 and the height of the guide walls 33 is smaller than the height of the head units 13 fixed on the frame 15. The arrangement pitch of the guide walls 33 is the same as the arrangement pitch of the head units 13 such that the head units 13 are positioned between the adjacent guide walls 33 in the width direction (arrangement direction). Further, the bottom plate 34 of the head unit fixing section 16 is parallel to the nozzle surfaces 58 of the head units 13, and an opening (not shown in the figure) is disposed on a part of the bottom plate 34 so as to expose the nozzle surface 58.

Moreover, two slide grooves 35*a*, 35*b* are formed on the side face of each guide wall 33 at different heights and extend in the extending direction of the guide wall 33 (the direction parallel to the bottom plate 34 and perpendicular to the arrangement direction of the head units 13) so as to engage with engagement projections 39*a*, 39*b* of the head unit 13, as is described more fully below. The slide groove 35*a* has a rear end which is inclined downward. The slide groove 35*b* is provided at a position lower than the slide groove 35*a*, and has a rear end which is inclined downward at a forward position relative to the rear end of the slide groove 35*a*. As shown in FIG. 6, the head units 13 are mounted between the adjacent guide walls 33 with the nozzle surfaces 58 being exposed downward. More specifically, in the state that the nozzle surface 58 of the head unit 13 faces downward when the head unit 13 is in standing position, the engagement projections 39*a* which are located on both sides at the rear end of the head unit 13 are engaged with the slide grooves 35*a* and the head unit 13 is slid from the front side of the extending direction of the guide wall 33 to a halfway point. Then, the engagement projections 39*b* which are located on both sides at the middle of the head unit 13 are engaged with the slide groove 35*b* and the head unit 13 is slid to the back side. When the head unit 13 is slid backward and reaches a predetermined position, the head unit 13 moves downward along the inclined portion of the slide grooves 35*a*, 35*b*. When the head unit 13 is fully moved to the back end, the head unit 13 is fixed on the head unit fixing section 16 with the nozzle surface 58 of the head unit 13 is exposed from the bottom plate 34.

Figure 7:
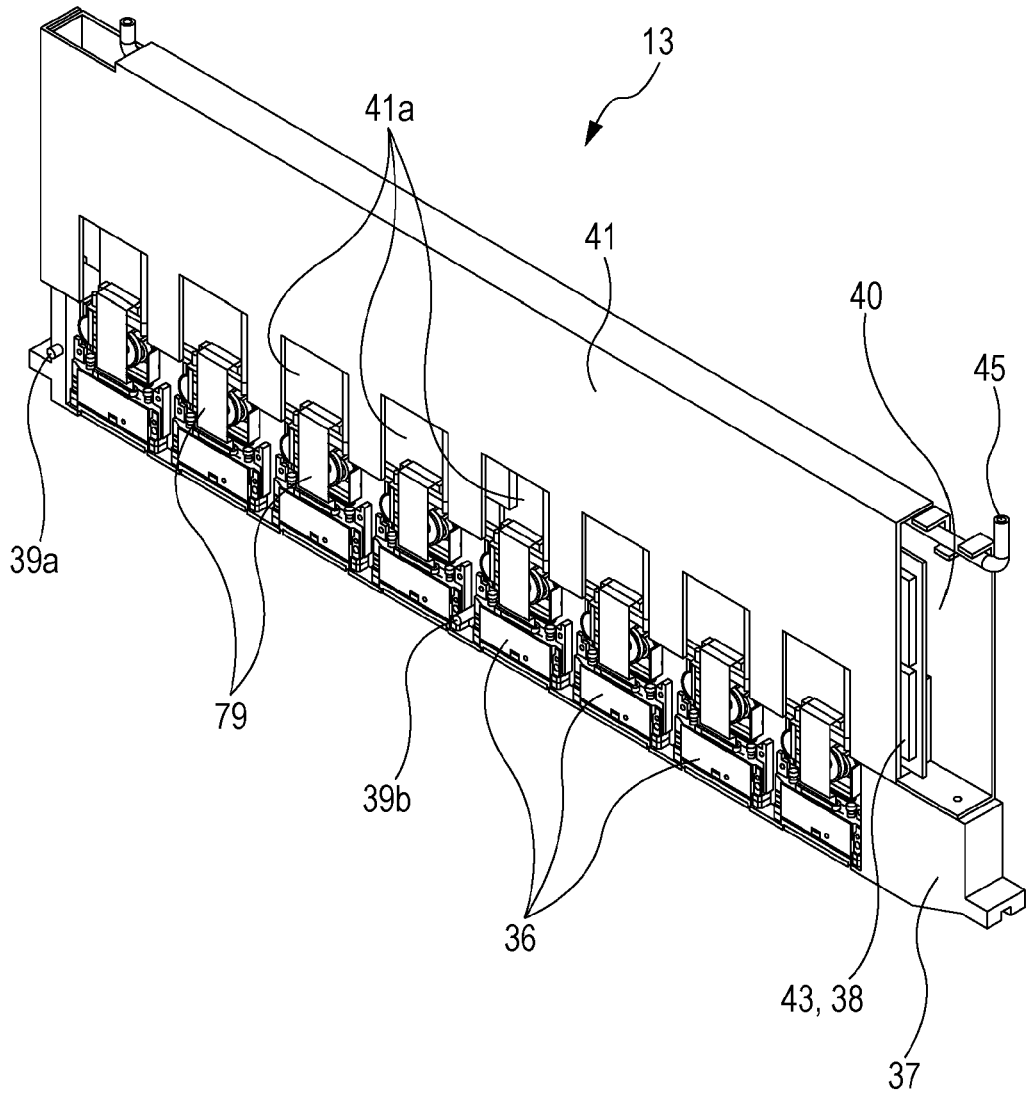
FIG. 7 is a perspective view of the head unit.
Figure 8:
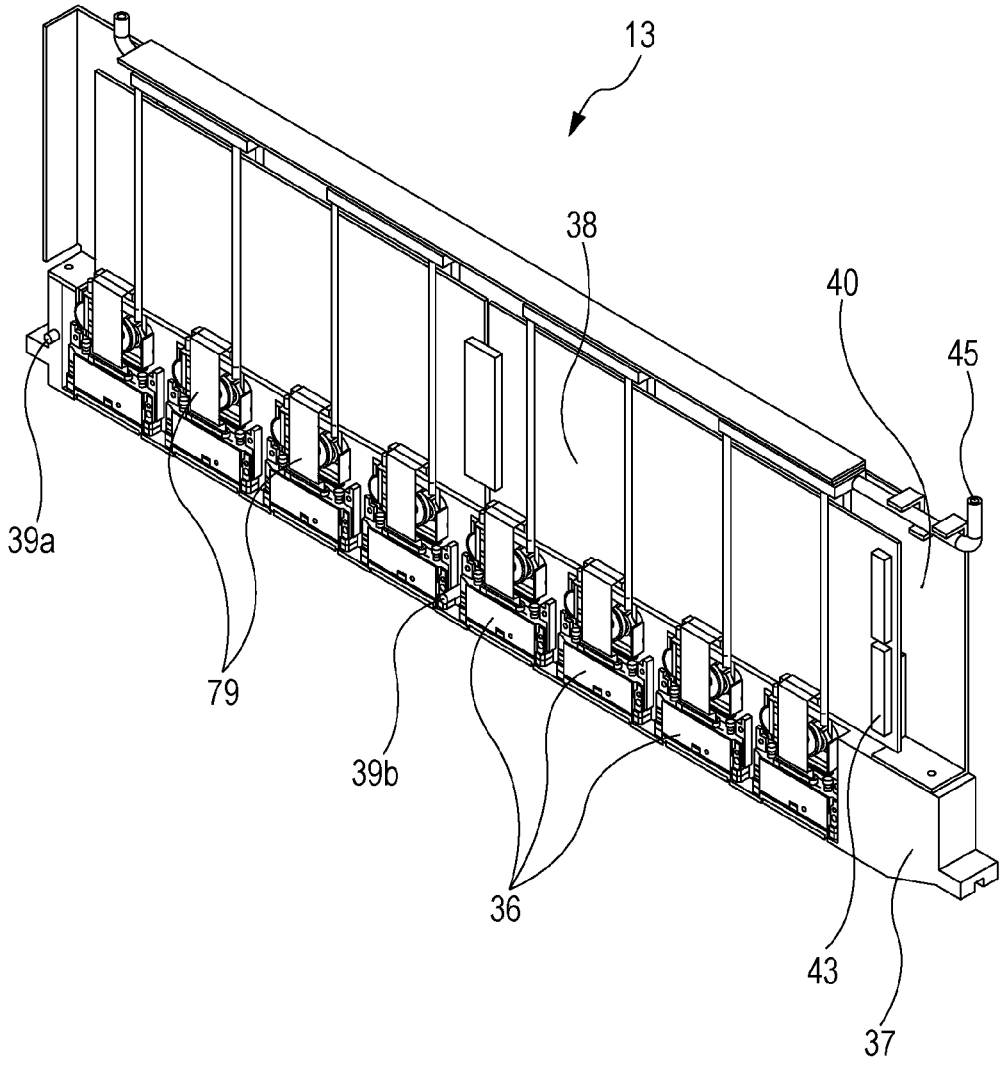
FIG. 8 is a perspective view of the head unit with a substrate cover removed.
Figure 9:
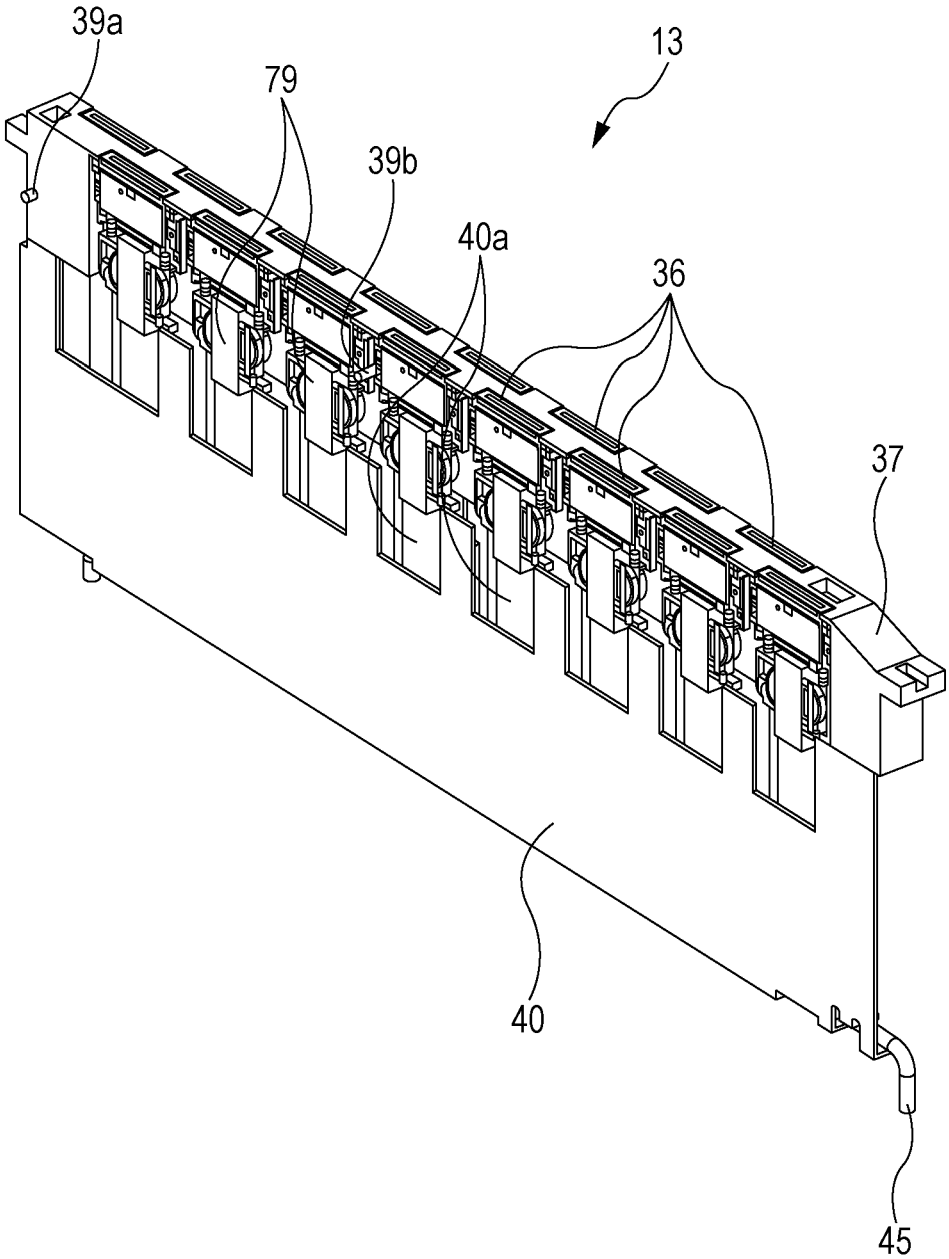
FIG. 9 is a perspective view of the head unit as seen from a nozzle surface.

Next, the head unit 13 will be described. FIGS. 7 and 8 are perspective views of the head unit 13 as seen from the top side (the side opposite to the nozzle surface 58), and FIG. 9 is a perspective view of the head unit 13 as seen from the bottom side (the side of the nozzle surface 58). In FIG. 8, a substrate cover 41 for protecting the transmission substrate 38 has been removed.

As shown in the figure such as FIG. 7, the head unit 13 is a plate-shaped unit that includes a plurality of unit heads 36, a holding member 37 that holds the unit heads 36, the transmission substrate 38 that transmits control signals (drive signals) to the piezoelectric element, which will be described later. As shown in FIG. 9, on the head unit 13 of this embodiment, a row of the unit heads 36 which is composed of eight unit heads 36 are disposed on each side of the holding member 37. That is, sixteen unit heads 36 are provided. As shown in FIG. 9, the unit heads 36 mounted on one side of the holding member 37 and the unit heads 36 mounted on the other side of the holding member 37 are alternately arranged in the arrangement direction of the unit heads 36. That is, the unit heads 36 on one side and the unit heads 36 on the other side are offset by a half of the arrangement pitch of the unit heads 36. With the unit heads 36 arranged as described above, the nozzle surfaces 58 are exposed to the bottom of the head unit 13. Further, the engagement projections 39*a* for engaging with the higher slide grooves 35*a* are disposed on both sides on one end (rear end) of the holding member 37. The engagement projections 39*b* for engaging with the lower slide grooves 35*b* are disposed on both sides at the middle (in the front-back direction) of the holding member 37.

As shown in FIG. 7, a substrate fixing plate 40 that fixes the transmission substrate 38, and the substrate cover 41 that covers the transmission substrate 38 fixed on the substrate fixing plate 40 from the side opposite to the substrate fixing plate 40 are disposed on the holding member (on the side opposite to the nozzle surface 58) with the transmission substrate 38 being held in standing position between the substrate fixing plate 40 and the substrate cover 41. As shown in FIG. 8, a connector 43 is disposed on one end (front end) of the transmission substrate 38. The connector 27 is electrically connected to one end of the flexible cable 44. Further, each of the unit heads 36 are connected to one end of head cables 79. The other end of the head cables 79 are connected to a portion of the lower end of the transmission substrate 38 which corresponds to the unit heads 36. The transmission substrate 38 transmits control signals from the controllers 14 to the respective unit heads 36 via the flexible cables 44. Since the controllers 14 that control the head units 13 are disposed right above the head units 13, long flexible cables 44 which substantially vertically extend to the upper layer 19 and short flexible cables 44 which substantially vertically extend to the lower layer 20 are alternately arranged, as shown in FIGS. 2 and 3.

The substrate fixing plates 40 and the substrate covers 41 are made of a metal such as SUS so as to provide rigidity to the head units 13 and shield noise such as electromagnetic wave. Further, connection openings 40*a* are formed on the substrate fixing plate 40 so that the transmission substrate 38 is connected to the head cables 79 through the connection openings 40*a*. Similarly, connection openings 41*a* are formed on the substrate cover 41 so that the transmission substrate 38 is connected to the head cables 79 through the connection openings 41*a*. Further, an upper opening of the ink flow path 45 through which ink is supplied to each recording head is exposed at the upper position of the substrate fixing plate 40. The upper opening of the ink flow path 45 is connected to the lower end of the ink supply tube, which is not shown in the figure, in a liquid sealed manner, and the lower end of the ink flow path 45 is branched and connected to an ink introduction path 75 of the respective recording heads.

Figure 10:
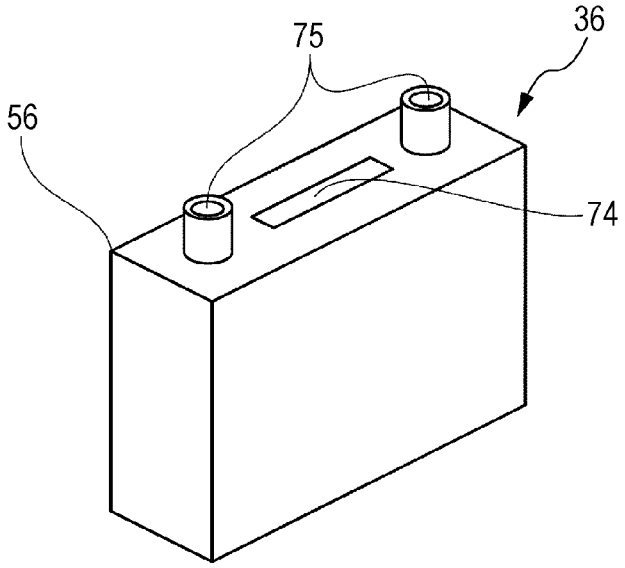
FIG. 10 is a perspective view of a unit head.
Figure 11:
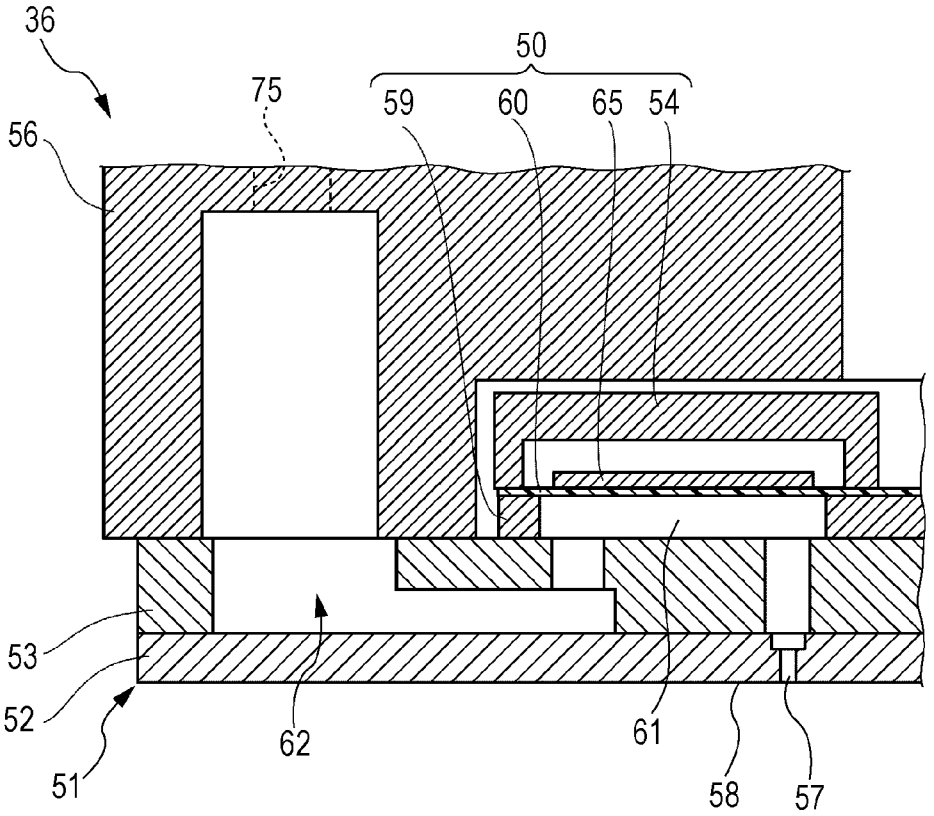
FIG. 11 is a perspective view of an essential part of the unit head.

Next, the unit head 36 will be described. FIG. 10 is a perspective view of the unit head 36, and FIG. 11 is a perspective view of an essential part of the unit head 36. In FIG. 11, only a portion of the configuration which corresponds to one nozzle row is shown, since the configuration is symmetrical.

As shown in FIG. 11, the unit head 36 of this embodiment includes a pressure generating unit 50 and a flow path unit 51 which are mounted on a case 56 in a stacked state. As shown in FIG. 10, each case 56 includes a through hole 74 in which one end of the head cable 79 is housed, and two ink introduction paths 75 which extend upward from the upper surface of the case 56. The flow path unit 51 includes a nozzle plate 52 (a type of nozzle forming member) on which nozzles 57 are formed, and a communication substrate 53 (a type of common liquid chamber forming member) on which a liquid supply flow path 62 that communicates with the ink introduction paths 75 is formed. The pressure generating unit 50 is formed as a unit of a stack of a pressure chamber forming substrate 59 (a type of pressure chamber forming member), an elastic film 60, a piezoelectric element 65 (which corresponds to a pressure generating section of the invention), and a protection substrate 54. When the ink is introduced to the pressure chamber 61 via the liquid supply flow path 62, and the control signals from the controller 14 are supplied to the piezoelectric element 65 via the flexible cable 44, the transmission substrate 38, and the head cable 79, a pressure change is generated in the pressure chamber 61 by driving the piezoelectric element 65. Ink droplets are ejected through the nozzles 57 by using the above described pressure change. Further, the underside of the nozzle plate 52 corresponds to the nozzle surface 58.

As described above, the frame 15 of the recording head 3 according to the invention includes the head unit fixing section 16 and the controller fixing section 17 which is stacked on the head unit fixing section 16 on the side opposite to the nozzle surface 58. The head units 13 are arranged side by side with the nozzle surfaces 58 being exposed in the head unit fixing section 16, and the controllers 14 are arranged side by side in the arrangement direction of the head units 13 in the controller fixing section 17. The controller fixing section 17 is composed of a stack of the upper layer 19 and the lower layer 20, and the controllers 14 which correspond to adjacent head units 13 in the arrangement direction in the head unit fixing section 16 are arranged alternately in the upper layer 19 and the lower layer 20 of the controller fixing section 17. Accordingly, even if the width of the controller 14 is larger than the width of the head unit 13, the entire width of the arranged controllers 14 can be substantially same as the entire width of the arranged head units 13 which are arranged as compact as possible. As a result, the recording head can be reduced in size.

Although the controller fixing section 17 in the above embodiment is composed of a stack of the upper layer 19 and the lower layer 20, the configuration is not limited thereto. For example, the layer section can be formed as a stack of three or more layers. That is, the controller fixing section may be formed as a stack of at least two layers, and the controllers which correspond to adjacent head units in the head unit fixing section may be arranged alternately in the different layers. Further, although the pressure generating section in the above embodiment is described by way of example of so-called vibration type piezoelectric element 65, the pressure generating section is not limited thereto. For example, a vertical vibration type piezoelectric element or a heat generating element may be used.

Although the ink jet recording head mounted on the ink jet printer is described in the above embodiment, the invention may be applied to a liquid ejecting head that ejects liquid other than ink. For example, the invention may be applied to color material ejecting heads used for manufacturing the color filters for liquid crystal displays and the like, electrode material ejecting heads used for forming electrode for organic electro luminescence (EL) displays, field emission displays (FED) and the like, and bioorganic ejecting heads used for manufacturing biochips.

What is claimed is:

1. A liquid ejecting head comprising:

a head unit in which a plurality of unit heads are arranged, the unit heads being configured to eject a liquid through a nozzle formed on a nozzle surface by using a pressure change in a pressure chamber which is generated by driving a pressure generating section;

each of the plurality of unit heads corresponding to a respective controller that transmits a control signal for controlling driving of the pressure generating section; and a frame on which a plurality of the head units and the controllers which correspond to the head units are fixed, wherein the frame includes a head unit fixing section in which the head units are arranged side by side with the nozzle surface being exposed and a controller fixing section which is stacked on the head unit fixing section on the side opposite to the nozzle surface and in which the controllers are arranged side by side in an arrangement direction of the head units, the controller fixing section is composed of at least two layers, and the controllers which correspond to adjacent head units in the arrangement direction in the head unit fixing section are arranged alternately in the at least two layers in the controller fixing section.

2. The liquid ejecting head according to claim 1, wherein a thickness of the controller in the arrangement direction is larger than a thickness of the head unit in the arrangement direction.

3. A liquid ejecting apparatus comprising the liquid ejecting head according to claim 2.

4. The liquid ejecting head according to claim 1, wherein the head unit includes a transmission substrate that transmits the control signal to the pressure generating section, the transmission substrate and the controller being electrically connected via a wire member, and each of the wire members being arranged so as to not cross each other.

5. A liquid ejecting apparatus comprising the liquid ejecting head according to claim 4.

6. The liquid ejecting head according to claim 1, wherein the controller includes a heat dissipation section that dissipates heat into air, the controller fixing section includes a through hole on a bottom face at a position which corresponds to the heat dissipation section, and a blower that blows air toward the controller via the through hole, the blower being disposed at a position which faces the through hole.

7. The liquid ejecting head according to claim 6, wherein the controller fixing section includes pairs of positioning members that are disposed in each of the at least two layers so that the pairs of positioning members hold the controller from both sides in a direction that the different layers are stacked, and wherein the through hole is disposed on the positioning member at a position which faces the blower.

8. A liquid ejecting apparatus comprising the liquid ejecting head according to claim 7.

9. A liquid ejecting apparatus comprising the liquid ejecting head according to claim 6.

10. A liquid ejecting apparatus comprising the liquid ejecting head according to claim 1.

11. A liquid ejecting apparatus comprising:

a liquid ejecting head comprising:

a head unit in which a plurality of unit heads are arranged, the unit heads being configured to eject a liquid through a nozzle formed on a nozzle surface by using a pressure change in a pressure chamber which is generated by driving a pressure generating section;

each of the plurality of unit heads corresponding to a respective controller that transmits a control signal for controlling driving of the pressure generating section; and a frame on which a plurality of the head units and the controllers which correspond to the head units are fixed, wherein the frame includes a head unit fixing section in which the head units are arranged side by side with the nozzle surface being exposed and a controller fixing section which is stacked on the head unit fixing section on the side opposite to the nozzle surface and in which the controllers are arranged side by side in an arrangement direction of the head units, the controller fixing section is composed of at least two layers, and the controllers which correspond to adjacent head units in the arrangement direction in the head unit fixing section are arranged alternately in the at least two layers in the controller fixing section, wherein the head unit includes a transmission substrate that transmits the control signal to the pressure generating section, the transmission substrate and the controller being electrically connected via a wire member, and each of the wire members being arranged so as to not cross each other, wherein the controller includes a heat dissipation section that dissipates heat into air, the controller fixing section includes a through hole on a bottom face at a position which corresponds to the heat dissipation section, and a blower that blows air toward the controller via the through hole, the blower being disposed at a position which faces the through hole.

* * * * *